US009080230B2

(12) United States Patent
Hahn et al.

(10) Patent No.: US 9,080,230 B2
(45) Date of Patent: Jul. 14, 2015

(54) STEEL ALLOY FOR FERRITIC STEEL HAVING EXCELLENT CREEP STRENGTH AND OXIDATION RESISTANCE AT ELEVATED USAGE TEMPERATURES

(75) Inventors: Bernd Hahn, Ratingen (DE); Joachim Konrad, Düsseldorf (DE); André Schneider, Paderborn (DE); Charles Stallybrass, Düsseldorf (DE)

(73) Assignee: VALLOUREC DEUTSCHLAND GMBH, Düsseldorf (DE)

( * ) Notice: Subject to any disclaimer, the term of this patent is extended or adjusted under 35 U.S.C. 154(b) by 482 days.

(21) Appl. No.: 13/055,345

(22) PCT Filed: Jul. 3, 2009

(86) PCT No.: PCT/DE2009/000953

§ 371 (c)(1),
(2), (4) Date: Apr. 25, 2011

(87) PCT Pub. No.: WO2010/009700

PCT Pub. Date: Jan. 28, 2010

(65) Prior Publication Data

US 2011/0189496 A1 Aug. 4, 2011

(30) Foreign Application Priority Data

Jul. 23, 2008 (DE) ..... 10 2008 034 817
Jun. 30, 2009 (DE) ..... 10 2009 031 576

(51) Int. Cl.
*C22C 38/52* (2006.01)
*C22C 38/06* (2006.01)
*C22C 38/40* (2006.01)

(52) U.S. Cl.
CPC ..... *C22C 38/06* (2013.01); *C22C 38/40* (2013.01); *C22C 38/52* (2013.01); *Y10T 428/12014* (2015.01)

(58) Field of Classification Search
CPC ..... C22C 38/06; C22C 38/40; C22C 38/52
USPC ..... 148/519; 420/38
See application file for complete search history.

(56) References Cited

U.S. PATENT DOCUMENTS 6,296,953 B1 * 10/2001 Linden et al. ..... 428/681
6,332,936 B1 12/2001 Hajaligol et al.

(Continued)

FOREIGN PATENT DOCUMENTS

DE 692 04 123 T2 2/1993
DE 696 08 744 T2 8/1996

(Continued)

OTHER PUBLICATIONS

Stallybrass et al.: "Ferritic Fe—Al—Ni—Cr alloys with coherent precipitates for high-temperature applications", in: Material Science and Engineering A, Dec. 15, 2004, vol. 387-389, pp. 985-990.

(Continued)

*Primary Examiner* — Jie Yang
(74) *Attorney, Agent, or Firm* — Henry M. Feiereisen LLC.

(57) ABSTRACT

A steel alloy with excellent creep strength and corrosion resistance that is ferritic at usage temperatures above 620° C. has the following chemical composition (in wt. %): C≤1.0%; Si≤1.0%; Mn≤1.0%; P max. 0.05%; S max. 0.01%; 2≤Al≤12%; 3≤Cr≤16%; 2≤Ni≤10% and/or 2≤Co≤10%, where 2≤Ni+Co≤[% Cr]+2.07×[% Al]>=0.95×([% Ni]+[% Co]); N max. 0.0200%. The remainder is iron with steel production-related impurities. Optionally, one or more elements of V, Ti, Ta, Zr, Nb, Mo and W, as well as one or more elements of Hf, B, Se, Y, Te, Sb, La and Zr with a cumulative content of <0.1% can be added. The steel structure includes uniformly distributed coherent precipitates based on a chromium-stabilized (Ni, Co)Al—B2 intermetallic ordered phase.

8 Claims, 2 Drawing Sheets

(56) References Cited

U.S. PATENT DOCUMENTS

| | | | | |
|---|---|---|---|---|
| 2002/0124913 | A1 | 9/2002 | Uehara et al. | |
| 2003/0192626 | A1 * | 10/2003 | Takiguchi et al. | 148/405 |
| 2006/0060270 | A1 | 3/2006 | Kluch et al. | |
| 2011/0226386 | A1 * | 9/2011 | Roch | 148/219 |

FOREIGN PATENT DOCUMENTS

| | | | |
|---|---|---|---|
| DE | 199 41 411 | A1 | 3/2000 |
| DE | 601 10 861 | T2 | 10/2001 |
| JP | 03 236449 | A | 10/1991 |
| WO | WO 03/029505 | | 4/2003 |

OTHER PUBLICATIONS

Stallybrass et al.: "The strengthening effect of (Ni, Fe) AL precipitates on the mechanical properties at high temperatures of ferritic Fe—Al—Ni—Cr alloys", in: Intermetallics, vol. 13, 2005, pp. 1263-1268.

* cited by examiner

STEEL ALLOY FOR FERRITIC STEEL HAVING EXCELLENT CREEP STRENGTH AND OXIDATION RESISTANCE AT ELEVATED USAGE TEMPERATURES

CROSS-REFERENCES TO RELATED APPLICATIONS

This application is the U.S. National Stage of International Application No. PCT/DE2009/000953, filed Jul. 3, 2009, which designated the United States and has been published as International Publication No. WO 2010/009700 and which claims the priority of German Patent Applications, Serial No. 10 2008 034 817.1, filed Jul. 23, 2008 and Serial No. 10 2009 031 576.4, filed Jun. 30, 2009, pursuant to 35 U.S.C. 119(a)-(d).

BACKGROUND OF THE INVENTION

The invention relates to a steel alloy for a ferritic steel with excellent creep strength and oxidation resistance at elevated usage temperatures.

More particularly, the invention relates to seamless or welded pipes from the steel alloy, which are used, for example, as heat exchanger pipes in heaters or power plant boilers in temperature ranges of above 620° C. to about 750° C.

High-temperature materials with high creep strength and corrosion resistance for, for example, application in power plants are based generally either on ferritic, ferritic/martensitic or austenitic iron-based alloys or on nickel-based alloys. The specific requirements in the lower temperature stages of the heat exchanger pipes relate in particular to a small thermal expansion.

Austenitic materials cannot be used because their thermal expansion is too high in the aforedescribed temperature range. The ferritic/martensitic materials available to date can also not be employed in the boiler at the enhanced temperatures, because their creep strength and heat resistance combined with adequate corrosion resistance are no longer sufficient.

Nickel-based alloys with nickel content of more than 50 wt.-% represent an adequate combination of corrosion resistance and heat resistance properties. These steels are therefore extremely expensive and processing into seamless pipes is also quite problematic.

Pipes made of austenitic steels with low requirements for thermal expansion have been used to date for components in power plant boilers. The high alloying costs (Ni to 30%), the inferior machinability and the inferior thermal conductance are here disadvantageous.

Chromium-rich ferritic steel is significantly less expensive than austenitic stainless steel, while also having a higher thermal conductivity coefficient and a lower thermal expansion coefficient. In addition, chromium-rich ferritic steel also has a high oxidation resistance which is advantageous when used with hot steam, for example in heaters or boilers.

However, when oxide layers are produced in form of a coating (scale or scale layer), then these oxide layers can detach when the boiler temperature and/or the boiler pressure change, and get stuck in and plug up the steel pipes.

In addition to the required creep strength and heat resistance, suppressing oxidation from steam is therefore one of the problems that foremost require a solution.

For improving the efficiency of the energy generation in power plants, there is increasing a requirement to increase the steam temperature to above 620° C. and to also increase the steam pressure in the boiler.

The market forces hence require ferritic iron-based alloys for pipes and/or pipelines which exhibit the required creep strength and corrosion properties also at higher usage temperatures above 620° C. For example, creep strengths of 105 hours at this temperature exposure for a load of 100 MPa should be attained without cracking.

Steels available for a usage temperature up to about 620° C. and 650° C., respectively, are ferritic/martensitic steels with Cr-contents of, for example, 8 to 15%.

Corresponding steels are disclosed, for example, in the documents DE 199 41 411 A1, DE 692 04 123 T2, US 2006/0060270 A1, DE 601 10 861 T2 and DE 696 08 744 T2. The alloying concepts disclosed therein involve mostly expensive alloying additives or are also not suitable for use in temperature ranges above 620° C.

Concepts based on incoherent MX- or $M_2X$-precipitates for increasing the creep strength (DE 199 41 411 A1, DE 601 10 861 T2, US 2006/0060270 A1) have several disadvantages.

The aforementioned precipitation phases cannot be produced in sufficient volume fractions, because an increase of the contents of the metallic (e.g., Ti, Nb or V) as well as the non-metallic components (C or N) does not only increase the phase fraction, but also increases the solution temperature of the phase. The creation temperature of the precipitates is then above a realistic heat treatment temperature and partially also above the solidus temperature of the alloy.

Because the temperature at which precipitates are produced is directly related to their size, one either obtains a relatively small volume fraction of effective reinforcing particles (<1%) or a high volume fraction of coarse particles (>1 μm), which have no effect on the creep strength. The MX- and $M_2X$-particles precipitate preferably in the interior of the grain. It can be expected that the influence from grain boundary creep relative to the creep caused by dislocations increases at usage temperatures of >630° C.

A depletion of reinforcement phases at grain boundaries therefore deserves a particularly critical evaluation.

Moreover, the incoherent precipitates have a greater tendency to become coarser than coherent precipitates because, on one hand, the boundary surface energy as a driving force for minimizing boundary surfaces is greater than for coherent particles and, on the other hand, easily diffusing elements, such as C and N, are a component of these particles.

Other conventional alloying concepts that use intermetallic phases for increasing creep strength of ferritic or martensitic steels (DE 698 08 744 T2) are based on expensive alloying materials.

For adjusting a sufficiently high volume fraction of intermetallic phases with the structure L10 or L12, the extremely expensive alloying elements Pt and Pd, which have to date only been available in small quantities, with fractions about 1 wt.-% are required.

The alloy described in WO 03/029505 is an improvement over the FeCrAl-alloy known under the name Kanthal, which is used, for example, for heating elements operating at temperatures above 1000° C. These alloys have a high chromium and aluminum content for efficiently converting electric energy into heat.

The combination of high chromium and aluminum contents results in alloys that with chromium contents above 16% and aluminum contents above 4% are fully ferritic even at temperatures above 750° C. The steels are not suitable for use in power plant applications; moreover, chromium contents above 16% worsen the deformability at typical processing temperatures when rolling seamless pipes (900-1200° C.). This diminished deformation characteristic can result in crack formation during rolling. As a result, such alloys are not suitable for the production of pipes or sheet metal.

U.S. Pat. No. 6,322,936 B1 describes exclusively intermetallic alloys produced by powder metallurgy for the production of sheet metal based on the system Fe—Al and includes the intermetallic phases $Fe_3Al$, $Fe_2Al_5$, $FeAl_3$, FeAl, FeAlC, $Fe_3AlC$, and combinations of these phases. A disordered phase, for example ferrite, is not included. The described FeAl—B2 phase is in these documents used only as a matrix. The powder-metallurgical production of such intermetallic alloy is not suitable for the large-scale production of pipes and sheet metal.

It is an object of the invention to provide a cost-effective steel alloy for a steel which is ferritic at the usage temperature and which reliably satisfies the aforedescribed requirements with respect to the creep strength and oxidation resistance also at usage temperatures of up to about 750° C.

It is another object to provide workpieces produced with this steel alloy, for example hot-rolled seamless or welded pipes, sheet metal, cast workpieces or tool steels.

SUMMARY OF THE INVENTION

According to the teaching of the invention, a steel alloy with the following chemical composition (in wt.-%) is proposed:

C≤1.0%
Si≤1.0%
Mn≤1.0%
P max. 0.05%
S max. 0.01%
2≤Al≤12%
2≤Cr<16%
2≤Ni≤10% and/or
2≤Co≤10%
with
2≤Ni+Co≤15% and
0.11×[% Cr]+2.07×[% Al]≤0.95×([% Ni]+[% Co])
N max. 0.0200%
remainder iron with melt-related impurities,
- with optional addition of one or several elements of V, Ti, Ta, Zr and Nb,
- with optional addition of one or both elements of Mo and W,
- with optional addition of one or several elements of Hf, B, Se, Y, Te, Sb, La and Zr in a range of a cumulative contents of <0.01%, with the proviso that the steel structure comprises uniformly distributed coherent precipitates based on a chromium-stabilized (Ni, Co)Al—B2 intermetallic ordered phase.

The alloying concept according to the invention is fundamentally different from conventional alloying concepts. The alloy which is fully ferritic up to a usage temperature of 750° C. attains its excellent creep strength and corrosion properties according to the novel innovative approach due to coherent, finely-distributed precipitates of nanoparticles of a (Ni, Co)Al—B2 intermetallic ordered phase which is stabilized with chromium.

The precipitates are coherent with the ferritic matrix and uniformly and finely distributed in the structure, both in the interior of the grain as well as near grain boundaries. Advantages of this steel alloy are significantly reduced costs, and the coherent precipitates of the intermetallic (Ni, Co)Al—B2 phase also significantly increase the creep strength compared to conventional alloying concepts at temperatures above 620° C., and even above 650° C. to about 750° C.

The concept on which the invention is based eliminates expensive and difficult to obtain elements for producing an intermetallic reinforcement phase. The (Ni, Co)Al phase with B2-structure require significantly less Ni and Co contents than conventional austenitic steels.

The particular characteristics of the B2-phase in the Fe—Cr—Al(Ni, Co) system is its distinct miscibility gap for (Ni, Co)Al, which can be controlled by way of the Cr-content.

Therefore, a high volume fraction can be intentionally adjusted at a usage temperature and a solution temperature favorable for the process by varying the contents of Cr, Al and Ni or Co.

DETAILED DESCRIPTION OF PREFERRED EMBODIMENTS

Various experimental melts (VS) are listed in the following Table.

B2-phase contents in steel above 8 mole-% are disadvantageous because of the associated reduced viscosity and the inferior mechanical machinability of the steel, and should therefore be avoided.

Figure 1:
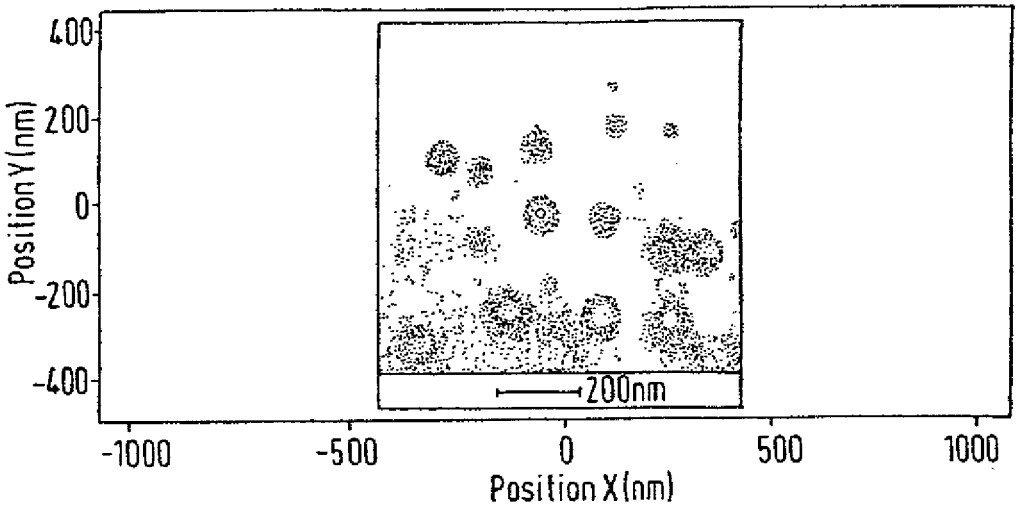
FIG. 1 shows an image of the microstructure, produced by STEM, as well as the chemical composition of the matrix and the B2-phase of VS1 determined with EDX.
Figure 1:
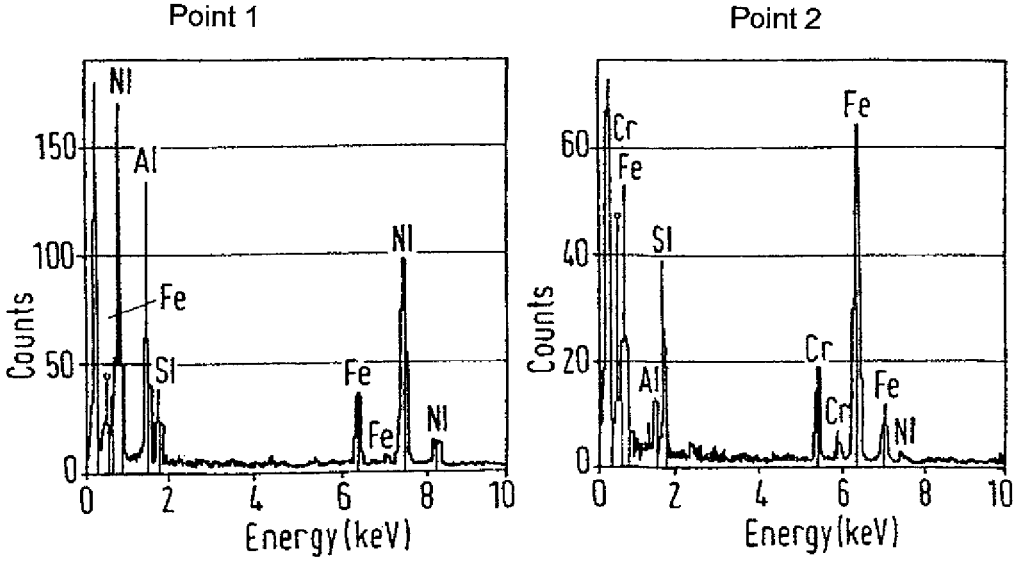

A very fine and uniform distribution of precipitates can be attained due to the coherence of the B2-phase in the ferritic crystal lattice. The small boundary surface energy also results in a low driving force for increasing the coarseness (FIG. 1).

TABLE

Experimental melts with listing off the chemical compositions (in wt.-%) and the thermodynamically calculated values for the molar fraction of the B2-phases and their solution temperature (B2 sol).

| | VS1 | VS2 | VS3 |
|---|---|---|---|
| C | 0.21 | 0.02 | 0.02 |
| S | 0.187 | 0.23 | 0.2 |
| M | 0.168 | 0.05 | 0.05 |
| P | 0.025 | 0.02 | 0.02 |
| S | 0.006 | 0.002 | 0.002 |
| A | 4.2 | 6.0 | 5.1 |
| C | 18.1 | 13.0 | 11 |
| N | 4.09 | 5.0 | 4 |
| T | 0.02 | 0.024 | — |
| N | — | — | 0.1 |
| N | 0.006 | 0.005 | 0.005 |
| B | 0.005 | 0.005 | 0.005 |
| B2 at 650° C. | 5.6 mole-% | 8.1 mole-% | 5.9 mole-% |
| B2 sol | 852° C. | 988° C. | 869° C. |

Figure 2:
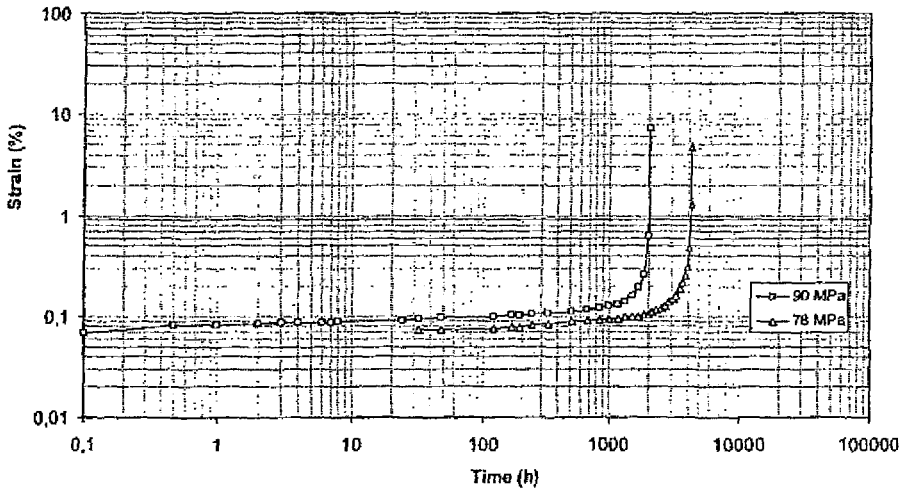
FIG. 2 shows the results of isothermal creep tests at 650° C. and a constant tension on the probes of the laboratory melt VS3.

This fine distribution of the B2-phase increases the creep strength and produces a very low creep rate in the region of the secondary creep (FIG. 2).

The elements Ni, Al and a small quantity of Fe were detected in the B2-phase. Fe, Cr, Al and Si were detected in the matrix. The average particle radius of the B2-NiAl phase is about 40 nm, the molar phase fraction is about 5.6%.

The increasing coarseness of the particles of the B2-NiAl phase was computed with a program for computing precipitation and growth characteristics of phases. In a simulated precipitation at 650° C., an average particle radius of 147 nm is computed after 100,000 hours.

The increase coarseness within the timeframe used for conventional qualifications is therefore significantly less than the value of about 500 nm identified as maximal effective average particle radius.

According to the invention, Cr with a percentage of 2 to <16 wt.-% is alloyed to the steel to sufficiently stabilize the B2-phase for usage temperatures above 620° C. to about 750° C.

In an advantageous embodiment of the invention, the resistance to oxidation is also significantly increased by adjusting an excess of Al relative to Ni and Co, respectively (leaner than stoichiometric for adjusting NiAl and CoAl, respectively).

The excess fraction of Al is then adjusted, depending of the Cr-contents, in addition to the stoichiometric fraction of the B2-(Ni, Co)Al formation as follows:

2% Cr: >8% Al,
5% Cr: >3% Al,
15.9% Cr: ≥2.5% Al, wherein the excess Al-content is interpolated for intermediate values of Cr.

In general, the composition should be selected so that at the usage temperature a stable structure composed of a ferritic structure and the (Ni, Co)Al—B2 phase is formed as main components.

To ensure the ferritic structure at the usage temperature, the following composition in wt.-% must be maintained:

$$0.11\times[\%\ Cr]+2.07\times[\%\ Al]\geq 0.95\times([\%\ Ni]+[\%\ co]).$$

Because of the high fundamental hardness of the steel alloy according to the invention at room temperature, the B2 phase contents to <8 mole-% is advantageously adjusted to ensure the mechanical machinability and the mechanical properties, such as the viscosity. This is attained by limiting the sum of the Ni and Co contents to values ≤15%.

The elements Si and Mn may be present only as part of accompanying elements found in steel or may be alloyed for additional mixed-crystal-hardening in percentages of each up to 1%. Percentages of max. 0.4% for Si and 0.5% for Mn has proven to be advantageous. Si is used for slightly increasing the heat resistance. If the heat resistance is the major purpose of the application, then higher percentages are recommended. Higher concentrations of Mn have a negative effect on the steam oxidation behavior. If this risk is nonexistent in the particular application, then more Mn can be alloyed as additional element for increasing the strength at room temperature and elevated temperatures.

If additional Si is not alloyed to the steel for deoxidation, then deoxidation is produced by the already very high Al content.

The C content is of lesser importance for the present alloying concept, but should not be below a value of 1.0%. Maximal percentages of 0.5% have proven to be advantageous. Percentages above 1% make machining more difficult and promote the generation of coarse and hence detrimental special carbides. The generation of the special carbides is significantly reduced for C content of less than 0.5%. Depending on the usage temperature, the C content must be adjusted to prevent a strong precipitation and growth of these special carbides in the particular application.

Deterioration in the machinability was also observed for Cr contents above about 16%, so that the Cr content is limited according to the invention to less than 16%. In addition, Cr contents in excess of 16% hinder also the ferrite-austenite phase transformation, which in the alloy of the invention begins above the usage temperature. This phase transformation advantageously allows modification of the structure and therefore the mechanical properties. In addition, the difference in the lattice parameters between the ferritic face and the B2-precipitates can be controlled by adding Cr, which is preferably dissolved in the ferritic phase. Conversely, Co is preferably dissolved in the B2-phase and allows control of the lattice parameter of this phase, so that the kinetic process for increasing coarseness of the precipitates can be controlled by both effects.

In another advantageous embodiment, a homogeneous and fine-grain structure is adjusted for increasing the fundamental strength and viscosity of the steel, which is obtained by way of micro-alloying one or several elements of V, Ti, Ta, Zr or Nb, wherein the carbon present in the steel is bound in form of fine MX-carbides. The following maximum percentages have proven to be advantageous:

max. 0.3% V,
max. 0.1% Ti,
max. 1.0% Ta,
max. 0.05% Zr,
max. 0.2% Nb, with a maximal total content of 0.5% having proven to be advantageous.

Additional elements under consideration for increasing the strength/creep strength via mixed crystal hardening or precipitation of fine intermetallic phases are Mo and W, which can be additionally alloyed with maximum percentages of 1% (Mo) and 2% (W), respectively.

Because of the undesired formation of primary AlN, the N content should be adjusted to be as small as possible and limited to a maximum of 0.0200%.

In addition, boundary-surface-active elements can be additionally alloyed for intentionally affecting both internal boundary surfaces, such as grain boundaries and phase boundaries, as well as boundary surfaces with the protective oxide layer. These include elements such as Hf, B, Y, Se, Te, Sb, La and Zr, which are added with a cumulative percentage of <0.1%.

Although the steel alloy can advantageously be used, for example, for heat exchanger pipes in power plants, its application is not limited thereto. In addition to the production of pipes, which can be seamlessly hot-rolled or welded, the steel alloy can also be used for the manufacture of sheet metal, cast pieces, spin-cast pieces, or tools for mechanical machining (tool steels), wherein the field of application extends to pressurized vessels, boilers, turbines, nuclear power plants or the construction of chemical equipment, i.e., to all fields having similar temperature requirements and corrosion exposure.

Although the steel alloy of the invention can be employed particularly advantageously above 620° C. to about 750° C. due to its excellent creep strength and oxidation properties, its application is already advantageous, for example, at temperatures above 500° C., if the strength of the material is an important consideration.

The invention claimed is:

1. A product selected from the group consisting of seamless steel pipe, welded steel pipe, steel sheet, tool steel and workpiece, having excellent creep strength and corrosion resistance at usage temperatures above 620° C., and produced from a steel alloy having the following chemical composition, in weight %):

C from 0.02% to 1.0%
Si≤1.0%
Mn≤1.0%

P max. 0.05%
S max. 0.01%
2≤Al≤12%
2≤Cr≤16%
2≤Ni<5% and/or
2≤Co≤10%
with
2≤Ni+Co≤15% and
0.11x[% Cr]+2.07x[% Al]≥0.95x([% Ni]+[% Co])
N max. 0.0200%
remainder iron with melt-related impurities,
wherein the Al content and the Cr content are related to each other according to the following relationships: when Cr=2%, then 12%≥Al>8%; when Cr=5%, then 12%≥Al>3%; and when Cr=15.9% then 12%≥Al≥2.5%, with the A1 content being determined for intermediate Cr contents by linear interpolation, wherein a structure of the steel comprises uniformly distributed coherent precipitates based on a chromium-stabilized (Ni, Co) Al—B2 intermetallic ordered phase, and wherein a maximum percentage of said chromium-stabilized (Ni, Co) Al—B2 intermetallic ordered phase in the ferritic steel is 8 mole-%.

2. The product of claim 1, wherein the steel alloy further includes at least one element selected from the group consisting of V, Ti, Ta, Zr and Nb.

3. The product of claim 1, the steel alloy further includes at least one element selected from the group consisting of Mo and W.

4. The product of claim 1, the steel alloy further includes at least one element selected from the group consisting of Hf, B, Se, Y, Te, Sb, La and Zr having a cumulative contents of <0.01%.

5. The product of claim 1, wherein an average particle size of the precipitates is smaller than 500 nm.

6. The product of claim 1, wherein an average particle size of the precipitates is smaller than 50 nm.

7. The product of claim 1, wherein the steel alloy further includes, in weight-%:

max. 0.3% V,
max. 0.1% Ti,
max. 1.0% Ta,
max. 0.05% Zr,
max. 0.2% Nb,
max. 1.0% Mo, and
max. 2.0% W.

8. The product of claim 1, wherein the C content is max. 0.5%, Si content is max. 0.4%, and Mn content is max. 0.5%.

* * * * *